US005562945A

United States Patent [19]

Hijino et al.

[11] Patent Number: 5,562,945

[45] Date of Patent: Oct. 8, 1996

[54] METHOD FOR POST-CLEANING FINISHING DRYING

[75] Inventors: Masamichi Hijino, Hachioji; Michio Shirai, Kodaira; Kazuhisa Karaki, Hachioji, all of Japan

[73] Assignee: Olympus Optical Co., Ltd., Japan

[21] Appl. No.: 235,298

[22] Filed: Apr. 29, 1994

[30] Foreign Application Priority Data

Apr. 29, 1993 [JP] Japan ..... 5-128536
Feb. 4, 1994 [JP] Japan ..... 6-33022

[51] Int. Cl.[6] ..... B05D 1/18

[52] U.S. Cl. ..... 427/164; 427/165; 427/169; 427/430.1; 427/435; 427/443.2; 134/2; 134/40

[58] Field of Search ..... 427/387, 164, 427/165, 169, 430.1, 435, 443.2; 134/2, 40

[56] References Cited

U.S. PATENT DOCUMENTS

| | | | |
|---|---|---|---|
| 4,685,930 | 8/1987 | Kasprzak | 8/139.1 |
| 4,708,807 | 11/1987 | Kemerer | 252/8.6 |
| 5,316,692 | 5/1994 | John | 252/174.15 |

FOREIGN PATENT DOCUMENTS

| | | |
|---|---|---|
| 174751 | 10/1991 | Australia . |
| 2034488 | 4/1991 | Canada . |
| 3509266 | 3/1985 | Germany . |
| 3739711 | 11/1987 | Germany . |
| 1-318094 | 12/1989 | Japan . |
| 2-289693 | 11/1990 | Japan . |
| 2173508 | 10/1986 | United Kingdom . |
| 2200365 | 8/1988 | United Kingdom . |
| 2238793 | 6/1991 | United Kingdom . |

*Primary Examiner*—Shrive Beck
*Assistant Examiner*—Erma Cameron
*Attorney, Agent, or Firm*—Ostrolenk, Faber, Gerb & Soffen, LLP

[57] ABSTRACT

A method for post-cleaning finish drying is provided, by which finish drying of industrial parts can be conducted without leaving residues or corroding the cleaned material. In this method, finish drying can be performed without the use of freon being a cause of destruction of the ozonosphere. Preferably, a cleaned material is dipped (rinsed) in a low molecular weight siloxane having a content of organic compounds, such as dodecamethylpentasiloxane, of less than 0.01% by weight, taken out and dried. Also, preferably, the material rinsed with the low molecular weight siloxane is subjected to a vapor cleaning using a perfluorocarbon compound.

9 Claims, No Drawings

METHOD FOR POST-CLEANING FINISHING DRYING

BACKGROUND OF THE INVENTION

1. Field of the Invention

The present invention relates to a method for post-cleaning finish drying to be conducted in a final step subsequent to cleaning of industrial parts, in which finish drying of industrial parts, e.g., optical and molded parts composed of glass or plastic, metallic parts, ceramic parts and electronic parts, upon cleaning can be performed without causing the parts to have stain and residue, so that the industrial parts having undergone the finish drying can be directly fed to surface treatment, e.g., formation of a vacuum deposition film on the surface of the parts. In particular, the present invention is concerned with the method in which finish drying can be accomplished without the use of freon, the reduction of the use thereof being worldwide demanded in recent years.

2. Discussion of Related Art

Generally, for industrial parts, such as optical, molded and electronic parts, finish drying is performed after precision cleaning thereof for defatting. This post-cleaning finish drying has been performed by the vapor drying using 1,1,2-trichloro-1,2,2-trifluoroethane (freon 113). The freon 113 has predominantly been used because it is incombustible, has low toxicity to organisms, can rapidly be dried and exhibits selective dissolving power (fats and oils are effectively dissolved while polymeric materials, such as plastic and rubber, are not corroded).

However, freon 113 (and other perhaloethanes) are so chemically stable that the life thereof in the troposphere is long. Thus, freon 113 is diffused into the stratosphere, where it is decomposed by sunbeams to produce halogen radicals. The halogen radicals incur chain reaction with ozone to thereby destroy the ozonosphere. Therefore, the reduction of the use of freon 113 is strongly demanded. In accordance with the demand for the reduction of the use of freon 113 for the protection of the ozonosphere, proposals have been made to carry out finish drying by the use of a large variety of solvent mixtures and azeotropic compositions. For example, Japanese Unexamined Patent Application Publication No. 318094/1989 discloses a solvent composed of a mixture of freon 113, isopropyl alcohol and methyl ethyl ketone. Japanese Unexamined Patent Application Publication No. 289693/1990 discloses azeotropic compositions comprising dichlorotetrafluoropropane (freon 234) and an aliphatic lower alcohol, such as ethanol. Further, the finish drying using the vapor of isopropyl alcohol (IPA) is disclosed.

However, the mixture disclosed in Japanese Unexamined Patent Application Publication No. 318094/1989 contains freon 113 as an essential ingredient. Therefore, the reduction of the use of freon 113 is limited. On the other hand, the azeotropic compositions disclosed in Japanese Unexamined Patent Application Publication No. 289693/1990 contain freon 234. From the viewpoint of destruction of the ozonosphere, freon 234 is less powerful than freon 113. However, freon 234 cannot completely be free from destruction of the ozonosphere. Further, the use of the vapor of IPA is not practical because it is likely to have influence from water, etc., it is inflammable to thereby have the danger of inflammation, and there is a problem of degrading plastics, etc.

SUMMARY OF THE INVENTION

The present invention has been made with a view toward obviating the above problems of the prior art.

Therefore, it is an object of the present invention to provide a method for post-cleaning finish drying in which freon destroying the ozonosphere is not used, the influence from water is less, the danger of inflammation at use is less, the cleaned material such as plastics is not corroded and stain and residue are not left after the drying.

The foregoing and other objects, features and advantages of the present invention will become apparent from the following detailed description and appended claims.

DETAILED DESCRIPTION OF THE INVENTION

The present invention is employed in the finish drying after of cleaning of industrial parts, e.g., optical and molded parts composed of glass or plastic, metallic parts, ceramic parts and electronic parts.

The terminology "finish drying" used herein means the final step of cleaning and drying operation, in which, subsequent to a single or a plurality of cleaning steps, the thus cleaned material is dipped in the fluid as defined in the present invention (finish drying fluid), taken out therefrom and dried by drying means such as hot air or vapor drying, and wherein the finish drying is conducted in the middle or final stage of manufacturing operation to thereby render the material surface clean and dry.

Thus the present invention is conducted in a final step subsequent to cleaning of industrial parts. Before the final step, the various conventional cleaning treatments, such as defatting of a material to be cleaned by the use of a surfactant or the like, water washing using, for example, demineralized water and alcohol replacement upon water washing, are conducted. Thereafter, the finish drying of the present invention is carried out. The finish drying of the present invention is principally divided into the following two methods.

The first method for post-cleaning finish drying according to the present invention comprises applying a low molecular weight siloxane having a dodecamethylpentasiloxane content of less than 0.01% by weight and containing substantially no compounds having volatilities lower than that of dodecamethylpentasiloxane.

The terminology "containing substantially no compounds" means that the content of the compounds is on a level such that they are not detected by the customary separating and analyzing means, such as GC (gas chromatography) or LC (liquid chromatography). The degree of volatility is evaluated on the criterion of vapor pressure, taking the latent heat of vaporization, etc. into account.

The low molecular weight siloxane for use in the first method may either be a linear siloxane or a cyclic siloxane. The siloxane may be used in pure form or in the form of a mixture. From the viewpoint of volatility and danger of inflammation, octamethyltrisiloxane (MW 248) and octamethylcyclotetrasiloxane (MW 312) are preferred and practical. A mixture of these low molecular weight siloxanes is also useful. The low molecular weight siloxane is used because its toxicity to organisms is low, it is chemically stable and has no corrosive effect on plastics, rubbers, metals and glasses and, further, it does not contain halogens, such as chlorine, so that there is no adverse effect on the ozonosphere and high safety is ensured.

In the first method for post-cleaning finish drying, the material cleaned by the cleaning step optionally with water replacement is dipped in the fluid for finish drying, taken out therefrom, and dried by allowing the material to stand still at room temperature, air blasting, vacuum drying, etc. These drying techniques may be employed either individually or in combination.

In the above method, a stabilizer or the like may be added. The stabilizer must exhibit high stabilization effect for the employed fluid for finish drying. The preferred stabilizer is one entrained in distillation operation or forming an azeotrope.

In the first method, use is made of the low molecular weight siloxane having dodecamethylpentasiloxane removed by distillation, rectification and/or adsorption with active carbon, etc. In the low molecular weight siloxane, the content of dodecamethylpentasiloxane is less than 0.01% by weight, and the compounds having volatilities lower than that of dodecamethylpentasiloxane are removed. Therefore, there is no occurrence of stain and residue after drying by air blasting or vacuum drying.

Table 1 shows results of the following experiment for confirming the effect of minutely contained less volatile components on finished conditions. In the experiment, dodecamethylpentasiloxane was added 0.001% by weight to each of octamethyltrisiloxane and octamethylcyclotetrasiloxane each having a purity of at least 99.999 % as measured by gas chromatography, which were obtained by a distilling equipment having a theoretical plate number of at least 30. A clean slide glass was dipped in each of the resultant fluids, taken out therefrom and dried by air blasting. The slide glass was subjected to the observation of any stain and residue by a stereo-microscope and the exhalation test in which breath was blown onto the slide glass and any stain and residue were examined by clouding conditions.

Further, the same experiment as above was conducted, except that tetradecamethylhexasiloxane was used instead of dodecamethylpentasiloxane. In the evaluation of Table 1, "o" indicates that no stain or residue is detected in both of the observation by a stereo-microscope and the exhalation test, and "x" indicates that stain or residue is detected in at least one of the observation by a stereo-microscope or the exhalation test. Table 1 shows only a summary of the above experiments. From the results, it is found that stain and residue are left either if dodecamethylpentasiloxane is contained in an amount of 0.01% by weight or more, or if tetradecamethylhexasiloxane less volatile than dodecamethylpentasiloxane is contained irrespective of the minute amount.

dodecamethylpentasiloxane, a linear siloxane having a molecular weight higher than that of dodecamethylpentasiloxane, dodecamethylcyclohexasiloxane, a cyclic siloxane having a molecular weight higher than dodecamethylcyclohexasiloxane and an organic compound having a molecular weight at least equivalent to said molecular weights. The terminology "substantially not containing", as in the above first step, means that the content of the above compounds is on a level such that they are not detected by the customary separating and analyzing means, such as GC (gas chromatography) or LC (liquid chromatography). In particular, in the second method, the above content means a value of about 10 ppm (0.001% by weight) or less. The low molecular weight siloxane for use in the second method may either be a linear siloxane or a cyclic siloxane. The siloxane may be used in pure form or in the form of a mixture. Low molecular weight dimethylsiloxanes are preferred. From the viewpoint of volatility and danger of inflammation, hexamethydisiloxane (MW 170) octamethyltrisiloxane, decamethyltetrasiloxane (MW 326) and octamethylcyclotetrasiloxane are preferred and practical among the low molecular weight dimethylsiloxanes. These low molecular weight dimethylsiloxanes may be used in the form of a mixture of at least two members thereof.

After the above rinsing, a vapor cleaning is performed, in which a perfluorocarbon compound is used as a vapor cleaning fluid. The perfluoro compound has excellent properties. That is, it is a colorless, transparent, odorless and inert liquid, has less attacking property on rubbers and plastics, and is incombustible and highly safe, and its ozone destruction coefficient is zero. A suitable perfluorocarbon compound is selected taking into account the compatibility with the rinse put in a pre-bath arranged before the vapor cleaning step and the thermal properties and consumption relating to the boiling point, latent heat of vaporization, etc. thereof. From the viewpoint of these properties, it is preferred that a perfluorocarbon compound having a boiling point of 100° C. or lower be used for materials with poor heat resistance, such as plastics, while a perfluorocarbon compound having a boiling point of 150° C. or lower be used for materials, such as metals and inorganic materials, taking into account the work efficiency in the subsequent steps. The perfluorocarbon compound having a boiling point of 150° C. or lower may be one or a mixture of at least two members selected from the group consisting of compounds with the basic formulae $C_6F_{14}$ (boiling point of 56° C.), $C_7F_{16}$ (boiling point of 80° C.) and $C_8F_{18}$ (boiling point of 102° C.).

TABLE 1

| | 0.001% by weight | | 0.002% by weight | | 0.009% by weight | | 0.010% by weight | | 0.011% by weight | |
|---|---|---|---|---|---|---|---|---|---|---|
| | A | B | A | B | A | B | A | B | A | B |
| Octamethyltrisiloxane | o | x | o | x | o | x | x | x | x | x |
| Octamethylcyclo-tetrasiloxane | o | x | o | x | o | x | x | x | x | x |

Note
Component A . . . Dodecamethylpentasiloxane
Component B . . . Tetradecamethylhexasiloxane The second method for post-cleaning finish drying according to the present invention comprises dipping a cleaned material in a rinse of a low molecular weight siloxane, taking out the material and then conducting a vapor cleaning in a final step subsequent to the cleaning operation.

In this second method, use is made of a rinse of a low molecular weight siloxane substantially not containing In the second method as well, a stabilizer or the like may be added. As in the first method, the stabilizer must exhibit high stabilization effect for the employed rinse. The preferred stabilizer is one entrained in distillation operation or forming an azeotrope.

The low molecular weight siloxane used as the rinse in the second method has dodecamethylpentasiloxane removed by distillation, rectification and/or adsorption with active carbon, etc. Thus, in the vapor cleaning step, the perfluorocarbon compound permeates into the interfacing portion between the material and the rinse adhering to the surface of the material to thereby replace the adhering rinse. Further, the vapor of the perfluorocarbon compound may replace the adhering rinse by virtue of the compatibility therebetween. If the rinse contains a compound sparingly compatible with the vapor of the perfluorocarbon compound, the replacement by the compatibility therebetween is difficult, thereby leaving stain and residue. Generally, with respect to the compatibility between the perfluorocarbon compound and the siloxane, if the basic structures are identical, it is in inverse proportion to molecular weights, and the greater the molecular weights the less the compatibility.

The low molecular weight siloxane employed in the rinsing step of the second method has sparingly compatible compounds substantially removed as mentioned above. The compatibilities between the low molecular weight siloxane as the rinse and the perfluorocarbon compound as the vapor cleaning fluid were evaluated by the following experiment.

Linear siloxanes, i.e., octamethyltrisiloxane, decamethyltetrasiloxane, tetradecamethylhexasiloxane and dodecamethylpentasiloxane, and cyclic siloxanes, i.e., octamethylcyclotetrasiloxane, decamethylcyclopentasiloxane and decamethylcyclohexasiloxane were individually added in a volume ratio of 50 % to 100 ml of each of boiling perfluorocarbons with the basic chemical formulae $C_7F_{16}$ (boiling point of 80° C.) and $C_8F_{18}$ (boiling point of 102° C.). The mixture was agitated, and heated. The state of the mixture upon reboiling was observed. Results are shown in Table 2. In the Table, "x" indicates that the perfluorocarbon compound and the siloxane are separated from each other. "▲" indicates that the perfluorocarbon compound and the siloxane form a clouded mixture. "o" indicates that the perfluorocarbon compound and the siloxane are compatible with each other to form a transparent solution.

TABLE 2

| | Octamethyl-trisiloxane | Decamethyl-tetrasiloxane | Dodecamethyl-pentasiloxane | Tetradecamethyl-hexasiloxane | Octamethyl-cyclotetra-siloxane | Decamethyl-cyclopenta-siloxane | Dodecamethyl-cyclohexa-siloxane |
|---|---|---|---|---|---|---|---|
| C7F16 | o | o | ▲ | x | o | ▲ | x |
| C8F18 | o | o | ▲ | x | o | ▲ | x |

As apparent from the above, it is preferred that the low molecular weight siloxane for use in the rinse substantially does not contain dodecamethylpentasiloxane, a linear siloxane having a molecular weight higher than that of dodecamethylpentasiloxane, dodecamethylcyclohexasiloxane, a cyclic siloxane having a molecular weight higher than dodecamethylcyclohexasiloxane and an organic compound having a molecular weight at least equivalent to the molecular weights. Desirable finish drying can be accomplished by performing a vapor cleaning using a perfluorocarbon compound after the dipping in a rinse and taking out therefrom.

PREFERRED EMBODIMENT OF THE INVENTION

The present invention will now be described in greater detail with reference to the following Examples, which should not be construed as limiting the scope of the present invention.

EXAMPLE 1

A glass lens, plastic lenses of polymethyl methacrylate (PMMA) and polycarbonate (PC) and a metallic part of aluminum were cleaned in the following manner.

First, each of the above materials to be cleaned was defatted in an alkali saponifier while applying ultrasonic vibration. Re-defatting was conducted in a surfactant while applying ultrasonic vibration. The material was washed in clean water while applying ultrasonic vibration to remove the surfactant. The material was further washed in demineralized water while applying ultrasonic vibration to remove ions and contaminants of clean water, thereby increasing the cleanliness of the material. For draining demineralized water, cleaning in IPA was conducted.

The thus cleaned material was dipped in a distillate obtained by distilling octamethyltrisiloxane using a distillation column having a theoretical-plate number of at least 30, as a finish drying fluid, taken out, and dried by air blasting.

The above finish drying fluid was analyzed by gas chromatography. It was found that the fluid contained 0.009 % of dodecamethylpentasiloxane but did not contain any compound less volatile than dodecamethylpentasiloxane. The gas chromatography was conducted by Gas Chromatograph GC14A (trade name, manufactured by Shimadzu Corp.), and the chromatography conditions were such that the injection temperature, the detection temperature and the temperature elevation rate from 50° to 250° C. were 260° C., 280° C. and 10° C./min, respectively. The FID detector and OV-1 capillary column were employed.

The finish dried conditions were evaluated by the observation by a stereo-microscope and the exhalation test. No stain and residue were detected, attesting to the performance of desirable finish drying.

EXAMPLE 2

A glass lens, plastic lenses of PMMA and PC and a metallic part of aluminum were cleaned in the following manner.

First, each of the above materials to be cleaned was defatted in an alkali saponifier while applying ultrasonic vibration. Re-defatting was conducted in a surfactant while applying ultrasonic vibration. The material was washed in clean water while applying ultrasonic vibration to remove the surfactant. The material was further washed in demineralized water while applying ultrasonic vibration to remove ions and contaminants of clean water, thereby increasing the cleanliness of the material. For draining demineralized water, cleaning in IPA was conducted.

The thus cleaned material was dipped in a distillate obtained by distilling octamethylcyclotetrasiloxane using a distillation column having a theoretical plate number of at least 30, as a finish drying fluid, taken out, and dried by air blasting.

The above finish drying fluid was analyzed by gas chromatography. It was found that the fluid contained 0.009 % of dodecamethylpentasiloxane but did not contain any compound less volatile than dodecamethylpentasiloxane.

As in Example 1, the finish dried conditions were evaluated by the observation by a stereo-microscope and the exhalation test. No stain and residue were detected, attesting to the performance of desirable finish drying.

EXAMPLE 3

A glass lens, plastic lenses of polymethyl methacrylate (PMMA) and polycarbonate (PC) and a metallic part of aluminum were cleaned in the following manner.

First, each of the above materials to be cleaned was defatted in an alkali saponifier while applying ultrasonic vibration. Re-defatting was conducted in a surfactant while applying ultrasonic vibration. The material was washed in clean water while applying ultrasonic vibration to remove the surfactant. The material was further washed in demineralized water while applying ultrasonic vibration to remove ions and contaminants of clean water, thereby increasing the cleanliness of the material. For draining demineralized water, cleaning in IPA was conducted.

EE-1120 (trade name, produced by Olympus Optical Co., Ltd.) was used as the alkali saponifier, and EE1110 (trade name, produced by Olympus Optical Co., Ltd.) was used as the surfactant. Before use, each of the alkali saponifier and the surfactant was diluted 8-fold. The output of the ultrasonic generator was 28 kHz-600 W. The cleaning act was 3 min in each of two alkali saponifier baths, two surfactant baths, three demineralized water baths and two IPA baths.

The thus cleaned material was dipped in a distillate obtained by distilling octamethyltrisiloxane using a distillation column having a theoretical plate number of at least 30, as a rinse, and taken out. Thereafter, vapor cleaning was conducted with a perfluorocarbon with the basic chemical formula $C_7F_{16}$ (boiling point of 80° C.

The above rinse was analyzed by gas chromatography. It was found that the fluid did not contain dodecamethylpentasiloxane, a linear siloxane having a molecular weight higher than that of dodecamethylpentasiloxane, dodecamethylcyclohexasiloxane, a cyclic siloxane having a molecular weight higher than dodecamethylcyclohexasiloxane and an organic compound having a molecular weight at least equivalent to the molecular weights. The gas chromatography was conducted by Gas Chromatograph GC14A (trade name, manufactured by Shimadzu Corp.), and the chromatography conditions were such that the injection temperature, the detection temperature and the temperature elevation rate from 50 to 250° C. were 260° C., 280° C. and 10° C./min, respectively. The FID detector and OV-1 capillary column were employed.

The finish dried conditions were evaluated by the observation by a stereo-microscope and the exhalation test. No stain and residue were detected, attesting to the performance of desirable finish drying.

EXAMPLE 4

A glass lens, plastic lenses of PMMA and PC and a metallic part of aluminum were cleaned in the following manner.

First, each of the above materials to be cleaned was defatted in an alkali saponifier while applying ultrasonic vibration. Re-defatting was conducted in a surfactant while applying ultrasonic vibration. The material was washed in clean water while applying ultrasonic vibration to remove the surfactant. The material was further washed in demineralized water while applying ultrasonic vibration to remove ions and contaminants of clean water, thereby increasing the cleanliness of the material. For draining demineralized water, cleaning in IPA was conducted. The above procedure was conducted under the same conditions as in Example 3.

The thus cleaned material was dipped in a distillate obtained by distilling octamethyltrisiloxane using a distillation column having a theoretical plate number of at least 30, as a rinse, and taken out. Thereafter, vapor cleaning was conducted with a perfluorocarbon with the basic chemical formula $C_8F_{18}$ (boiling point of 102° C.

The above rinse was analyzed by gas chromatography. It was found that the fluid did not contain dodecamethylpentasiloxane, a linear siloxane having a molecular weight higher than that of dodecamethylpentasiloxane, dodecamethylcyclohexasiloxane, a cyclic siloxane having a molecular weight higher than dodecamethylcyclohexasiloxane and an organic compound having a molecular weight at least equivalent to the molecular weights. The GC analysis was conducted under the same conditions as in Example 3.

As in Example 3, the finish dried conditions were evaluated by the observation by a stereo-microscope and the exhalation test. No stain and residue were detected, attesting to the performance of desirable finish drying.

EXAMPLE 5

A glass lens, plastic lenses of PMMA and PC and a metallic part of aluminum were cleaned in the following manner.

First, each of the above materials to be cleaned was defatted in an alkali saponifier while applying ultrasonic vibration. Re-defatting was conducted in a surfactant while applying ultrasonic vibration. The material was washed in clean water while applying ultrasonic vibration to remove the surfactant. The material was further washed in demineralized water while applying ultrasonic vibration to remove ions and contaminants of clean water, thereby increasing the cleanliness of the material. For draining demineralized water, cleaning in IPA was conducted. The above procedure was conducted under the same conditions as in Example 3.

The thus cleaned material was dipped in a distillate obtained by distilling decamethyltetrasiloxane using a distillation column having a theoretical plate number of at least 30, as a rinse, and taken out. Thereafter, vapor cleaning was conducted with a perfluorocarbon with the basic chemical formula $C_6F_{14}$ (boiling point of 56° C.

The above rinse was analyzed by gas chromatography. It was found that the fluid did not contain dodecamethylpentasiloxane, a linear siloxane having a molecular weight higher than that of dodecamethylpentasiloxane, dodecamethylcyclohexasiloxane, a cyclic siloxane having a molecular weight higher than dodecamethylcyclohexasiloxane and an organic compound having a molecular weight at least equivalent to the molecular weights. The GC analysis was conducted under the same conditions as in Example 3.

As in Example 3, the finish dried conditions were evaluated by the observation by a stereo-microscope and the exhalation test. No stain and residue were detected, attesting to the performance of desirable finish drying.

In Examples 3, 4 and 5, dodecamethylpentasiloxane, a linear siloxane having a molecular weight higher than that of dodecamethylpentasiloxane, dodecamethylcyclohexasiloxane, a cyclic siloxane having a molecular weight higher than dodecamethylcyclohexasiloxane and an organic compound having a molecular weight at least equivalent to the molecular weights, had substantially been removed from the low molecular weight siloxane used prior to the vapor cleaning. Therefore, in the vapor cleaning of the material, the compatibility is good between adhering low molecular weight siloxane and the perfluorocarbon as a vapor cleaning agent, so that desirable replacement is carried out to thereby bring about desirable finish drying. (Attacking Properties)

The effects of the low molecular weight siloxanes employed in Examples 1 to 5 were evaluated on the cleaned plastic materials, were evaluated. This evaluation was conducted by first preparing a test piece (5×50×2 mm) of each of an acrylic resin (PMMA), a glass-filled polycarbonate (PC), a polypropylene resin (PP) and an acrylonitrile-butadiene-styrene resin (ABS), secondly putting the test piece in a glass bottle, thirdly filling the bottle with each of the above low molecular weight siloxanes of Examples 1 to 5, fourthly allowing the same to stand still for 48 hr under ordinary temperature and humidity conditions, and finally taking out to measure the weight difference and any appearance change. As controls, freon 113 (Daikin Industries, Ltd.) and IPA were tested in the same manner. Results are shown in Table 3. In the Table, "o" indicates a weight difference of less than 1%, "▲" indicates a weight difference of 1% or more but no appearance change, and "x" indicates not only a weight difference of 1% or more but also occurrence of appearance change, such as cracks.

TABLE 3

| | PMMA | PC | PP | ABC |
|---|---|---|---|---|
| Example 1 | o | o | o | o |
| Example 2 | o | o | o | o |
| Example 3 | o | o | o | o |
| Example 4 | o | o | o | o |
| Example 5 | o | o | o | o |
| IPA | x | x | x | x |
| Freon 113 | o | o | ▲ | o |

The post-cleaning finish drying of the present invention can be employed in a final step subsequent to cleaning of industrial parts. The finish drying does not corrode the cleaned parts and does not leave stain and residue. Moreover, the finish drying does not use freon so that it does not cause destruction of the ozonosphere. The low molecular weight siloxane is useful as a substitute for freon.

What is claimed is:

1. A method for finish drying a cleaned material, comprising applying to said material an octamethyltrisiloxane having a dodecamethylpentasiloxane content of less than 0.01% by weight and containing substantially no compounds having volatilities lower than that of dodecamethylpentasiloxane.

2. The method for finish drying the cleaned material according to claim 1, comprising dipping the cleaned material in said octamethyltrisiloxane to thereby perform a rinsing in a final step subsequent to the cleaning of the material, and then performing a vapor cleaning using a perfluorocarbon compound.

3. The method according to claim 2, wherein said octamethyltrisiloxane has a content of dodecamethylpentasiloxane which is less than 0.001% by weight.

4. The method according to claim 2, wherein said vapor cleaning is performed using a perfluorocarbon compound having a boiling point of 150° C. or lower.

5. The method according to claim 2, wherein said perfluorocarbon compound is represented by the formula:

$$C_nF_{2n+2}$$

wherein n is 6 to 8.

6. The method according to claim 2, wherein said cleaned material is selected from the group consisting of a glass or plastic molded part, a metallic part, a ceramic part and an electrical part.

7. The method according to claim 6, wherein said vapor cleaning is performed using a perfluorocarbon compound having a boiling point of 150° C. or lower.

8. The method according to claim 7, wherein said perfluorocarbon compound is represented by the formula:

$$C_nF_{2n+2}$$

wherein n is 6 to 8.

9. The method according to claim 1, wherein said cleaned material is selected from the group consisting of a glass or plastic molded part, a metallic part, a ceramic part and an electrical part.

* * * * *